US006884088B2

(12) United States Patent
Kajinuma et al.

(10) Patent No.: US 6,884,088 B2
(45) Date of Patent: Apr. 26, 2005

(54) BALL GRID ARRAY TYPE IC SOCKET

(75) Inventors: Shuji Kajinuma, Kanagawa (JP); Masashi Inoue, Kanagawa (JP); Hiroshi Kaneko, Kanagawa (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/823,310

(22) Filed: Apr. 13, 2004

(65) Prior Publication Data

US 2004/0209492 A1 Oct. 21, 2004

(30) Foreign Application Priority Data

Apr. 15, 2003 (JP) ..... 2003-110257

(51) Int. Cl.[7] ..... H01R 12/00
(52) U.S. Cl. ..... 439/70; 439/83
(58) Field of Search ..... 439/70, 71, 73, 439/83, 342, 862

(56) References Cited

U.S. PATENT DOCUMENTS 6,132,222 A 10/2000 Wang et al.
6,431,878 B1 * 8/2002 Hirata et al. ..... 439/70
6,676,431 B2 * 1/2004 Kukita et al. ..... 439/342
6,676,432 B2 * 1/2004 Kukita et al. ..... 439/342
6,733,320 B2 * 5/2004 Kukita et al. ..... 439/342
2003/0092304 A1 * 5/2003 Whyne et al. ..... 439/342
2004/0058580 A1 * 3/2004 Shirai et al. ..... 439/342

* cited by examiner

*Primary Examiner*—Tho D. Ta
(74) *Attorney, Agent, or Firm*—Barley Snyder

(57) ABSTRACT

Solder balls are offset in the horizontal direction from fixing portions while their positional accuracy is ensured, and signal paths are shortened in a ball grid array IC socket. Contacts fixed to contact hosing apertures of a housing include base portions, contact arms, and terminal portions that extend from the lower ends of the base portions toward a circuit board. The contact arms protrude so as to extend upward and then are bent unidirectionally. The terminal portions are constituted by transition portions that link solder ball pads to the base portions, while offsetting the solder ball pads in the same direction as the contact arms. The transition portions include vertical portions which are substantially perpendicular to the solder ball pads or inclined portions angled upwardly from the solder ball pads. The vertical or inclined portions prevent movement of the solder balls, thereby preventing positional misalignment and deformation thereof.

7 Claims, 5 Drawing Sheets

BALL GRID ARRAY TYPE IC SOCKET

FIELD OF THE INVENTION

The present invention relates to a ball grid array type IC socket and more particularly to a socket having an insulating housing with electrical contacts provided in a matrix on the insulating housing for electrically connecting to a LGA (land grid array) or a BGA (ball grid array) of an IC package, while also electrically connecting the electrical contacts to a printed circuit board via solder balls.

BACKGROUND OF THE INVENTION

A ball grid array IC socket (hereinafter, simply referred to as "IC socket") is disclosed in U.S. Pat. No. 6,132,222 (FIG. 3). This IC socket comprises contacts for contacting pin contacts of an IC package. The contacts comprise contact arms for contacting the pin contacts, fixing portions for fixing the contacts to the insulative housing of the IC socket, and solder feet to be connected to the circuit board. Generally, the IC sockets are provided to consumers with solder balls soldered on to the solder feet.

In the known IC socket described above, the IC package has pin contacts. In the case that the IC package is a ball grid array (BGA) or a land grid array (LGA), the contacts of known IC sockets are modified to connect with the BGA or LGA contacts. The contact arms, which contact electrodes of the IC package, are curved after extending through an IC package mounting surface from the fixing portions, such that the contact points of the contact arms (i.e., the points on the contact arms that contact the contacts of the BGA or LGA) are horizontally offset. This horizontal offset reduces the height of the IC socket assembly having the IC package mounted thereon. The contacts of a ball grid array or a land grid array IC package are connected to the contact arms by application of a mechanical force. This construction is adopted in response to the miniaturization of products to which IC sockets are mounted.

For IC sockets with contact arms that are offset in the manner described above, it is preferable that the positions of the solder balls on the opposite side of the housing from the contacts, approach the positions of the contact points in the horizontal direction. That is, it is preferable that the solder feet are similarly offset from the fixing portions in the same direction as are the contact points of the contact arms. This offset is to balance the arrangement of the LGA or BGA of the IC package and the arrangement of the BGA of the IC socket.

Due to the recent and ongoing increases in the speed of transmitted signals, however, it is preferable that the signal paths of the contacts are as short as possible.

In view of the above, it is desirable that the solder feet are offset from the fixing portions, while providing the shortest possible signal paths from the IC package to the circuit board.

In the IC socket disclosed in U.S. Pat. No. 6,132,222, the solder feet are formed by bending the lower ends of the contacts, which extend downward from the fixing portions, at substantially a right angle. Therefore, in the case that the solder feet are to be offset, a problem arises in that the signal paths become elongated. In addition, solder fillets are formed between solder balls and the solder feet during soldering of the solder balls onto the solder feet. There is a possibility that the solder balls are pulled toward the right, that is, the side of the fixing portions, due to the surface tension of the molten solder fillets. This leads to the problem that the solder balls are formed on the solder ball pad at positions that deviate from their predetermined positions, where they are to be soldered to the circuit board. As a result, the positional accuracy of the solder balls will be deteriorated, thereby reducing the reliability of electrical connections. In addition, there is a risk that the spherical shapes of the solder balls will be altered due to the horizontal displacement thereof.

SUMMARY OF THE INVENTION

The present invention a ball grid array IC socket having an insulative housing and a plurality of contacts. The insulative housing has an IC package mounting surface on one face thereof and a circuit board mounting surface on a face opposite the IC package mounting surface and a plurality of contact housing apertures extending from the IC package mounting surface to the circuit board mounting surface configured to receive a plurality of contacts. The plurality of contacts include contact arms that protrude from the first surface in a unidirectionally bent manner for contacting contact portions of an IC package mounted on the IC package mounting surface, fixing portions for engaging the interiors of the plurality of contact housing apertures, solder ball pads that protrude from the circuit board mounting surface for soldering solder balls thereto for connecting to a circuit board, and transition portions provided between the fixing portions and the solder ball pads for displacing the solder ball pads in substantially the same direction as the direction in which the contact arms are bent.

BRIEF DESCRIPTION OF THE DRAWINGS

The present invention will be described with reference to the accompanying drawings, of which.

DETAILED DESCRIPTION OF THE INVENTION

Figure 1:
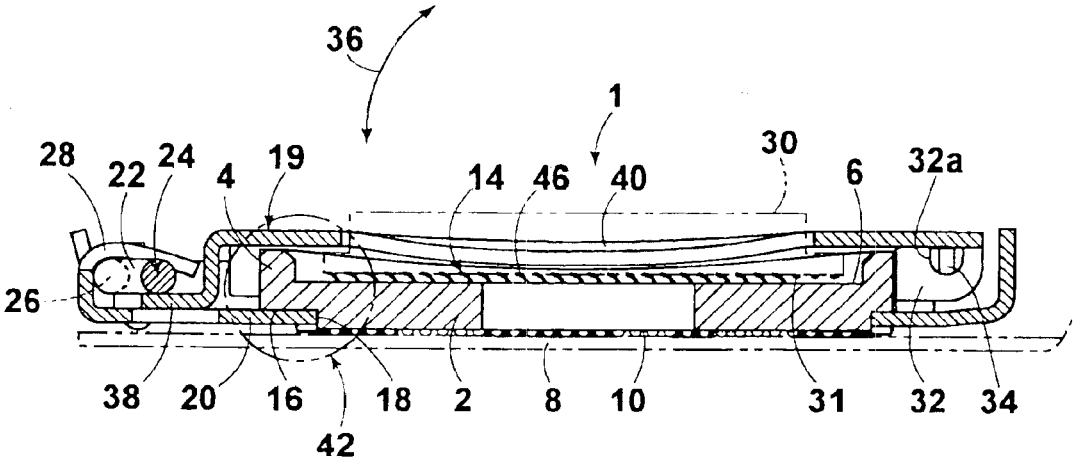
FIG. 1 is a cross sectional view of a ball grid array IC socket according to an exemplary embodiment of the present invention.

FIG. 1 shows a sectional view of an IC socket 1 according to an exemplary embodiment of the present invention. The IC socket 1 comprises an insulative housing 2, a metal plate 20, and a loading plate 19. The metal plate 20 supports the housing 2 from the side of a circuit board mounting surface 10 on the housing 2. The loading plate presses an IC package 30 onto the housing 2. The metal plate 20 and the loading plate 19 may be formed, for example, by stamping and forming.

Figure 2:
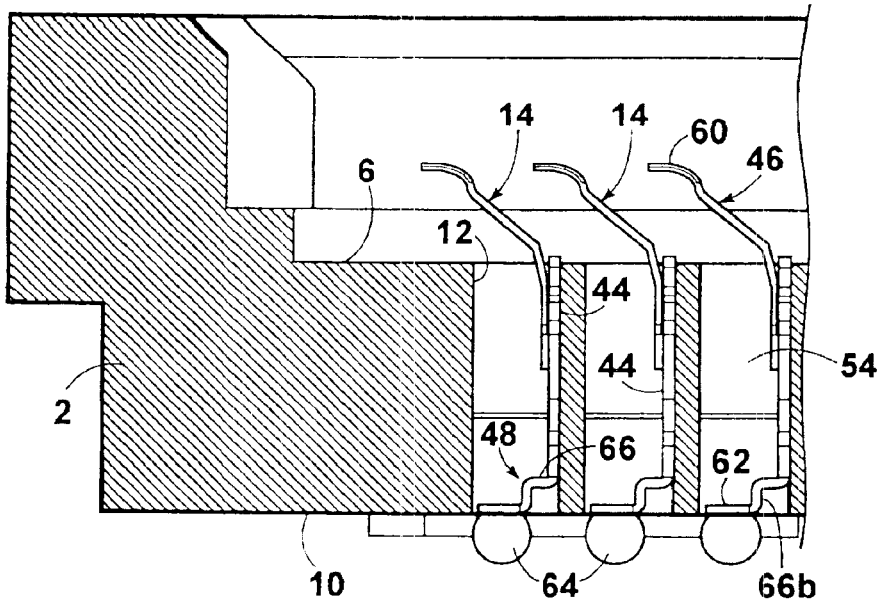
FIG. 2 is a detailed view of area 42 indicated in FIG. 1, showing only a housing and contacts.

The housing 2 of the IC socket 1 is rectangular. An IC package mounting surface 6 is provided on a first side of the housing 2, and the circuit board mounting surface 10 is provided on the other side of the housing 2. The IC package mounting surface 6 is surrounded by walls 4. The circuit board mounting surface 10 is configured to be mounted on a circuit board 8. Contact housing apertures 12, which will be described later (refer to FIG. 2), are formed through the housing 2 from the first side, which is the IC package mounting surface 6 (or upper surface as shown in FIG. 2), to the other side or board mounting surface 10, on which a circuit board 8 is mounted. The contact housing apertures 12 are arranged in a matrix. Contacts 14 are press fit and fixed within each of the contact housing apertures 12.

A step 16 is formed along the entire periphery of the lower surface of the housing 2. An opening 18 is formed in the metal plate 20 for receiving the lower portion of the housing 2, formed by the step 16. When the metal plate 20 and the housing 2 are assembled together, the edge of the plate 20 adjacent to the opening 18 abuts the step 16 in the housing 2. A support portion 28 is formed at one end of the metal plate 20, for example by bending. The support portion holds a rotating axis 26 of a lever 22 that operates the loading plate 19. A crank shaped operating portion 24 is formed on the rotating axis 26 to urge the loading plate 19 downward when it is rotated.

A bearing 32 is formed at the end of the loading plate 19 opposite from the end of the lever 22. The metal plate 20 is provided with claws 34 for rotatably engaging an aperture 32*a* formed through the bearing 32. This structure enables the loading plate 19 to rotate in the direction indicated by arrow 36 of FIG. 1. A tongue piece 38, which is to be pressed by the operating portion 24, is formed at the end of the loading plate 19 opposite the end of the bearing 32. In addition, a curved portion 40, which curves downward in FIG. 1, is formed at the central portion of the loading plate 19. When the loading plate 19 is closed by rotating the lever 22 and is in the position shown in FIG. 1, the curved portion 40 presses the IC package 30 (shown by broken lines in FIG. 1) toward the housing 2. Thus, electrodes 31 (contacts) of the IC package 30, that is, the LGA or the BGA, electrically connect with contact arms 46 of the contacts 14.

Figure 3C:
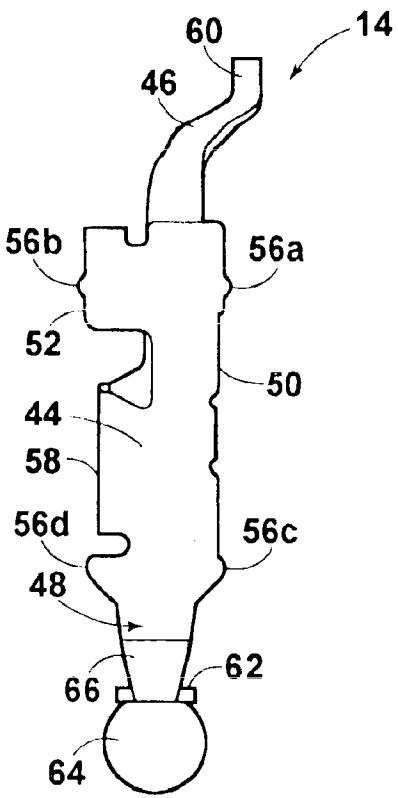
FIGS. 3A–4B show a contact utilized in the ball grid array IC socket according to an exemplary embodiment of the present invention with FIG. 3A being a left side view, FIG. 3B being a front view, and FIG. 3C being a right side view, FIG. 4A being a top plan view, and FIG. 4B being a bottom view of the contact.
Figure 3B:
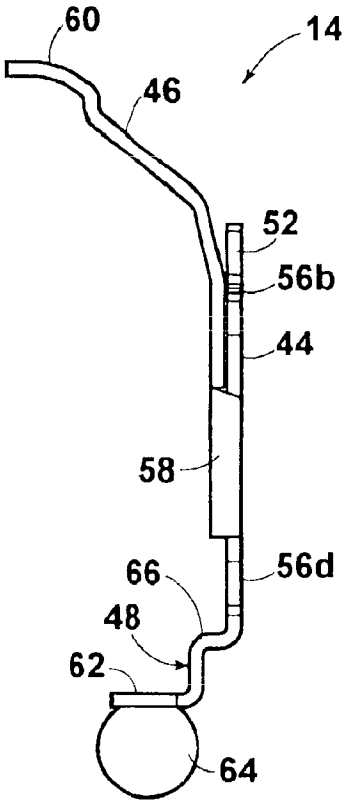
Figure 3A:
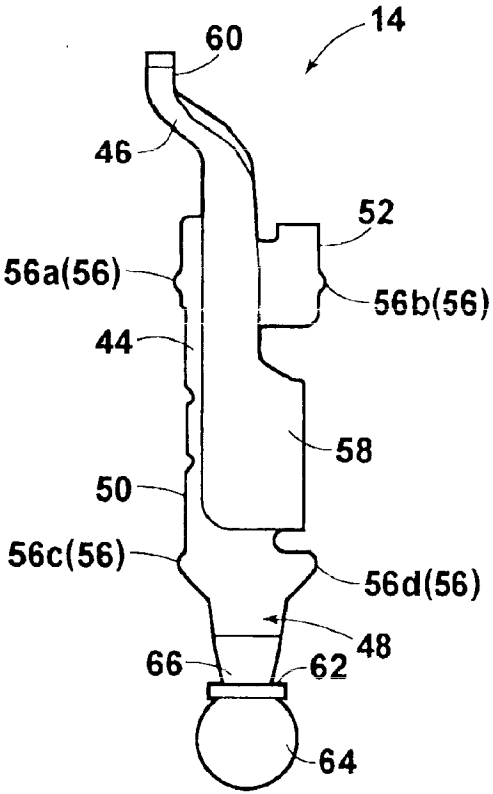
Figure 4A:
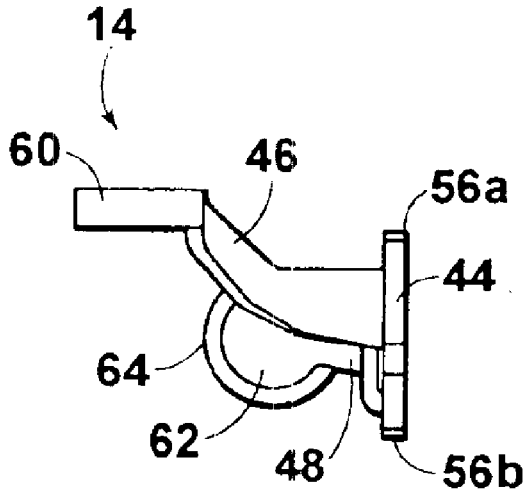
Figure 4B:
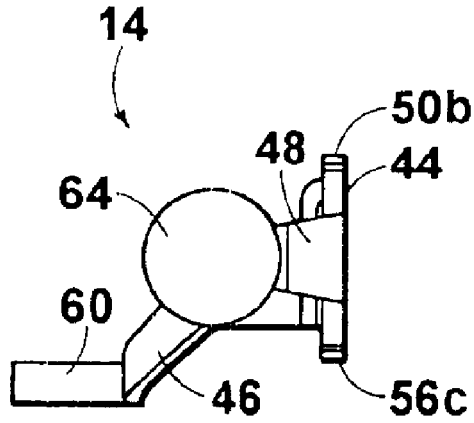

Next, the shape and the mounting structure of the contacts 14 will be described with reference to FIG. 2 through FIG. 4B. FIG. 2 is a detailed view of the area 42 indicated in FIG. 1, showing only the housing 2 and the contacts 14. FIGS. 3A, 3B, and 3C show the contact 14, which is utilized in the IC socket of the present invention. FIG. 3A is a left side view, FIG. 3B is a front view, and FIG. 3C is a right side view of the contact 14 of FIG. 2. FIG. 4A is a plan view, and FIG. 4B is a bottom view of the contact 14.

First, with reference to FIG. 2, it is clearly illustrated that the contacts 14 are engaged within the contact housing apertures 12 from the IC package mounting surface 6 to the circuit board mounting surface 10 of the housing 2. Each of the contacts 14 in the illustrated exemplary embodiment, as more clearly shown in FIGS. 3A, 3B, 3C, 4A, and 4B, is constructed by punching and bending a single metal plate. Each of the contacts 14 comprises a base portion 44 (also referred to as a fixing portion) that extends in the vertical direction of FIGS. 3A, 3B, and 3C; a contact arm 46 that extends from the base portion 44 upwardly; and a terminal portion 48 that extends form the lower end of the base portion 44 downwardly toward the circuit board 8. The contact arm 46, as best shown in FIGS. 3A and 3B extends from the side of the base portion 44, and is bent along a vertical line to overlap the base portion 44, and extending upwardly beyond the base portion 44. Note that the expressions up, down, left, and right will be employed to indicate those directions in each figure, to facilitate the description.

The shapes of each portion of the contact 14 will be described in further detail. As most clearly shown in FIG. 3C, engagement protrusions 56 (56*a*, 56*b*, 56*c*, and 56*d*), for frictionally engaging inner walls 54 of the contact housing apertures 12. The engagement protrusions 56 are formed at the top and bottom of the base portion 44 on both side edges 50 and 52 thereof. The contact arm 46 is bent from the side edge 52 of the base portion 44 at a bend 58. The contact arm 46 extends further upward from the bend 58, and is bent toward the left in FIG. 3B. A contact point 60, which has an arcuate upper surface for connecting with the contacts of the IC package 30, are provided at the distal ends of the contact arms 46.

The terminal portion 48 comprises: a solder ball pad 62, to which a solder ball 64 is soldered; and a transition portion 66, for linking the base portion 44 with the solder ball pad 62. The solder ball pad 62 is of a discoid shape having a diameter slightly smaller than that of the solder ball 64, and extends substantially parallel to the circuit board mounting surface 10. The transition portion 66 offsets the solder ball pad in substantially the same direction as that in which the contact point 60 is offset. The transition portion 66 will be described with reference to FIG. 5.

Figure 5:
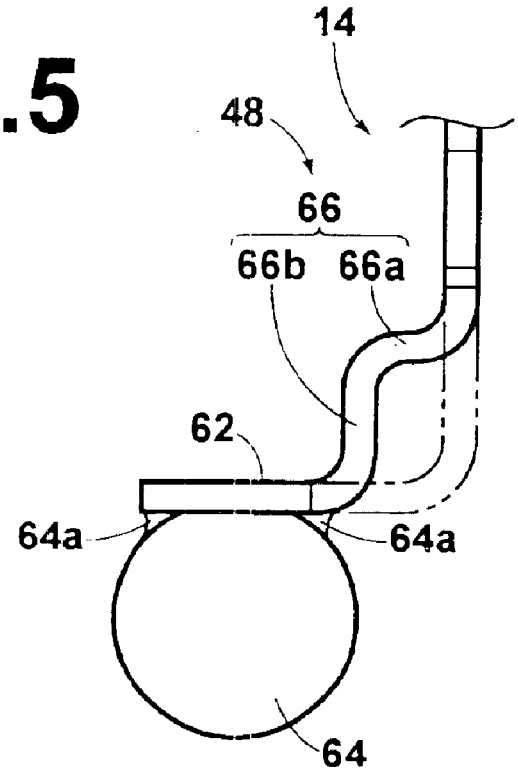
FIG. 5 is a partial detailed view of a terminal portion of the contact shown in FIGS. 3A–4B.

FIG. 5 is a partial detailed view that shows the terminal portion 48 of the contact 14 of FIGS. 3A–4B. The transition portion 66 comprises a horizontal portion 66*a* that extends substantially parallel to the circuit board mounting surface 10 and a vertical portion 66*b* that is continuous with the horizontal portion 66*a* and substantially perpendicular to the solder ball pad 62.

Next, the operation of the transition portion 66 will be described in further detail. During soldering of the solder ball 64 onto the solder ball pad 62 a solder fillet 64*a* is formed, by partially molten solder, between the solder ball pad 62 and the solder ball 64 around the entire periphery thereof. Because the vertical portion 66*b*, which is continuous with the solder ball pad 62, is formed perpendicular thereto, the solder fillet 64*a* does not flow toward the vertical portion 66*b*. Accordingly, the vertical portion 66*b* functions to prevent solder fillet formation thereon.

If the transition portion 66 extends rightward from the solder ball pad 62 then upward, as shown by the broken lines of FIG. 5, then the solder fillet 64*a* would flow toward the right from the solder ball pad 62. Then, the surface tension of the molten solder would cause the solder ball 64 to move to the right, and cause it to be fixed in a positionally misaligned state. As a result, the solder balls 64 and conductive pads of the circuit board (not shown) become misaligned, reducing the reliability of electrical connections therebetween.

In sharp contrast, the IC socket of the present invention allows the solder balls 64 to be consistently formed at their predetermined positions. Therefore, there is a reduced risk that positional misalignment will occur. In addition to the transition portion 66, the size of the solder ball pad 62 (slightly smaller than the solder ball 64) also works to achieve this characteristic. That is, the size of the solder ball pad 62 reduces the risk of horizontal movement of the solder ball 64, thereby contributing to accurate positioning thereof.

The transition portion 66 is not limited to being of the shape shown in FIG. 5. Various shapes may be considered, as long as they prevent the flow of the solder fillet 64*a*. For example, a modified contact 14, having a differently shaped transition portion, is shown in FIG. 6.

Figure 6:
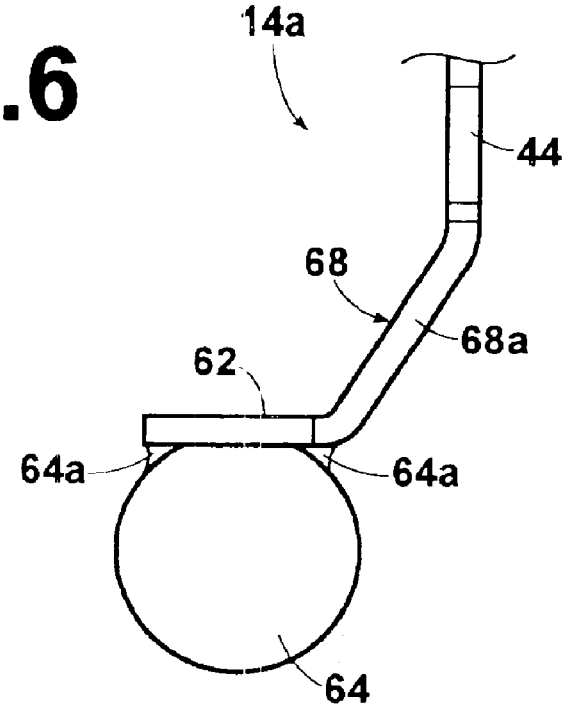
FIG. 6 is a partial detailed view of a modified contact having an inclined transition portion according to an alternate exemplary embodiment of the present invention.

FIG. 6 is a partial detailed view of a modified contact 14*a* having a transition portion 68 with a single inclined portion 68*a*. Note that of the parts illustrated in FIG. 6, those in common with the parts illustrated in FIGS. 3A through 5 will be denoted with the same reference numerals in the following description. The transition portion 68 is inclined. Therefore, it is difficult for the solder fillet 64*a* to flow upward along the inclined portion 68*a*. That is, it is difficult for the solder ball 64 to be pulled upward toward the transition portion 68. In addition, the incline portion 68*a* links the base portion 44 and the solder ball pad 62 with a shorter distance, thereby shortening the electrical path.

The transition portion may be of a variety of shapes that discourage movement of the solder fillet 64*a* toward the transition portion. For example, the shape of the transition portion may be a combination of the aforementioned vertical portion 66*b* and the inclined portion 68*a*. Alternatively, the transition portion may be formed as an arcuate shape that curves diagonally upward.

Figure 7:
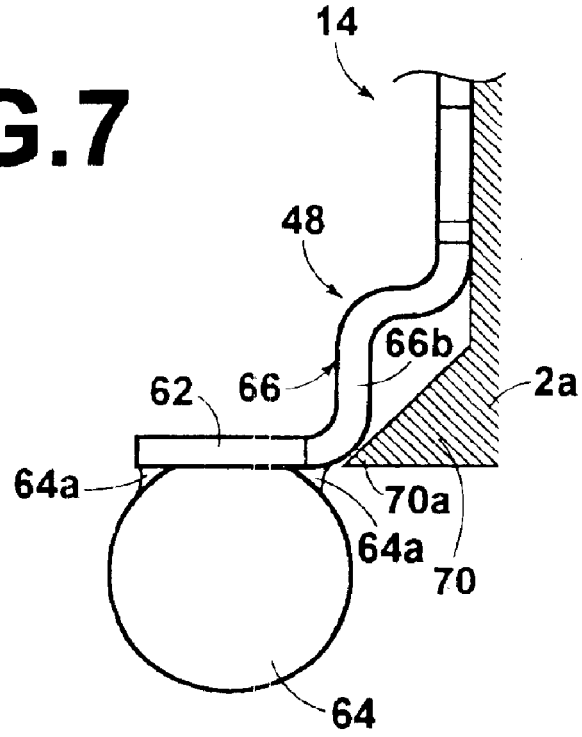
FIG. 7 is a partial detailed view of the contact shown in FIGS. 3A–4B with a housing according to an alternate exemplary embodiment of the present invention.

Next, an alternative exemplary embodiment of the present invention will be described with reference to FIG. 7. FIG. 7 is a partial detailed view showing the terminal portion 48 of the contact 14 of FIGS. 3A–4B, with an alternate housing 2*a*. In this embodiment, a protrusion 70 having a triangular cross section is provided on the circuit board mounting surface 10 of the housing 2*a*. The protrusion 70 is provided to discourage movement of the solder fillet 64*a* toward the transition portion 66 of the contact 14. The protrusion 70 extends from the fixing portion of the circuit board mounting surface 10, that is, the base portion 44 of the contact 14, to the solder ball pad 62. Therefore, the distal end 70*a* of the protrusion 70 prevents upward movement of the solder fillet 64*a* when it attempts to flow along the transition portion 66. Accordingly, movement and deformation of the solder ball 64 is further prevented.

Figure 8:
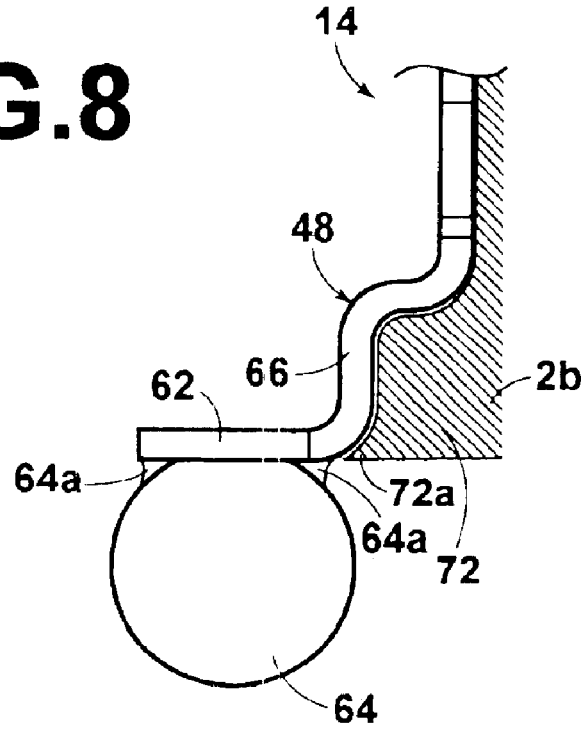
FIG. 8 is a partial detailed view of the contact shown in FIGS. 3A–4B with a modified housing according to an alternate exemplary embodiment of the present invention.

Next, a modification of the protrusion will be described with reference to FIG. 8. FIG. 8 is a partial detailed view showing the terminal portion 48 of the contact 14 with an alternative modified housing 2*b*. FIG. 8 shows a state in which the shape of a protrusion 72 (protrusive portion) copies that of the transition portion 66. That is, the protrusion 72 has a shape that is complementary to the right side of the transition portion 66 of the contact 14. In this case-as well, the distal end 72*a* of the protrusion 72 prevents movement of the solder fillet 64*a* toward the transition portion 66.

In addition, a protrusion may be formed in the housing 2, in combination with the contact 14*a* having the inclined transition portion 68 (shown in FIG. 6). Again, upward movement of the solder fillet 64*a* along the transition portion 68 can be prevented by such a protrusion.

In this manner, the transition portions 66 and 68 of the contacts 14 and 14*a* may act as solder fillet stops by themselves, without depending on the shape of the housing 2. However, by additionally providing the aforementioned protrusions 70 and 72 to the housings 2*a* and 2*b*, the solder balls 64 are enabled to be offset while more effectively preventing positional misalignment. In this manner, the protrusions 70 and 72 of the housings 2*a* and 2*b* also function as solder fillet stops.

While the invention is illustrated and described with reference to particular exemplary embodiments, it should be understood that alternative equivalent structures are contemplated within the scope of the invention. For example, metal plate 20 does not have to be formed from metal, but could be formed from a non-metallic material.

What is claimed is:

1. A ball grid array IC socket comprising:

an insulative housing having an IC package mounting surface on one face thereof and a circuit board mounting surface on a face opposite the IC package mounting surface and a plurality of contact housing apertures extending from the IC package mounting surface to the circuit board mounting surface and configured to receive a plurality of contacts; and a plurality of contacts; the contacts including contact arms that protrude from the first surface in a undirectionally bent manner for contacting contact portions of an IC package mounted on the IC package mounting surface, fixing portions for engaging the interiors of the plurality of contact housing apertures, solder ball pads that protrude from the circuit board mounting surface for soldering solder balls thereto for connecting to a circuit board, and transition portions provided between the fixing portions and the solder ball pads for displacing the solder ball pads in substantially the same direction as the direction in which the contact arms are bent, wherein the transition portions further comprise fillet stops for preventing fillets from forming on the transition portions during soldering of the solder balls on the solder ball pads.

2. A ball grid array IC socket as defined in claim 1, wherein the fillet stops comprise vertical portions of the transition portions substantially perpendicular to the circuit board mounting surface.

3. A ball grid array IC socket as defined in claim 1, wherein the fillet stops comprise inclined transition portions.

4. A ball grid array IC socket as defined in wherein the contact arms are bent from a side edge of the fixing portions at a bend and extend upward from the bend.

5. A ball grid array IC socket as defined in claim 4, wherein the contact arms have an arcuate upper surface for connecting with the contacts of the IC package at the distal ends of the contact arms.

6. A ball grid array IC socket comprising:

an insulative housing having an IC package mounting surface on one face thereof and a circuit board mounting surface on a face opposite the IC package mounting surface and a plurality of contact housing apertures extending from the IC package mounting surface to the circuit board mounting surface and configured to receive a plurality of contacts; and a plurality of contacts; the contacts including arms that protrude from the first surface in a undirectionally bent manner for contacting contact portions of an IC package mounted on the IC package mounting surface, fixing portions for engaging the interiors of the plurality of contact housing apertures, solder ball pads that protrude from the circuit board mounting surface for soldering solder balls thereto for connecting to a circuit board, and transition portions provided between the fixing portions and the solder ball pads for displacing the solder ball pads in substantially the same direction as the direction in which the contact arms are bent, wherein the housing further comprises protrusions that extend from the circuit board mounting surface to the ends of the solder ball pads for preventing fillets from forming on the transition portions during soldering of the solder balls on the solder ball pads.

7. A ball grid array IC socket comprising:

an inclusive housing having an IC package mounting surface on one face thereof and a circuit board mounting surface on a face opposite the IC package mounting surface and a plurality of contact housing apertures extending from the IC package mounting surface to the circuit board mounting surface and configured to receive a plurality of contacts; and a plurality of contacts: the contacts including contact arms that protrude from the first surface in a undirectionally bent manner for contacting contact portions of an IC package mounted on the IC package mounting surface, fixing portions for engaging the interiors of the plurality of contact housing apertures, solder ball pads that protrude from the circuit board mounting surface for soldering balls thereto for connecting to a circuit board, and transition portions provided between the fixing portions and the solder ball pads for displacing the solder ball pads in substantially the same direction in which the contact arms are bent, wherein the solder ball pad is of a discoid shape having a diameter slightly smaller than that of the solder ball.

* * * * *

UNITED STATES PATENT AND TRADEMARK OFFICE

CERTIFICATE OF CORRECTION

PATENT NO. : 6,884,088 B2
DATED : April 26, 2005
INVENTOR(S) : Kajinuma et al.

It is certified that error appears in the above-identified patent and that said Letters Patent is hereby corrected as shown below:

Column 6,
Line 36, after "as defined in" insert -- claim 1 --.

Signed and Sealed this

Sixth Day of December, 2005

JON W. DUDAS
*Director of the United States Patent and Trademark Office*